United States Patent [19]

Bindi

[11] Patent Number: 4,653,241

[45] Date of Patent: Mar. 31, 1987

[54] SYSTEM FOR INSULATING THE INTERIOR SURFACE OF BASEMENT WALLS, STRUCTURES AND COMPONENTS THEREFOR

[76] Inventor: Rene Bindi, 115 Aberdeen Avenue, Woodbridge, Ontario, Canada, L4L 1C3

[21] Appl. No.: 763,655

[22] Filed: Aug. 8, 1985

[51] Int. Cl.[4] ..... E02D 27/00

[52] U.S. Cl. ..... 52/169.11; 52/404; 52/746

[58] Field of Search ..... 52/169.11, 169.5, 289, 52/404, 408, 410, 735, 746, 506, 364, 406, DIG. 6

[56] References Cited

U.S. PATENT DOCUMENTS

| | | | |
|---|---|---|---|
| 1,770,439 | 7/1930 | Thompson | 52/410 |
| 2,580,231 | 12/1951 | Cann | 52/DIG. 6 X |
| 4,000,595 | 1/1977 | Fortescue | 52/410 X |
| 4,052,831 | 10/1977 | Roberts et al. | 52/746 X |
| 4,288,951 | 9/1981 | Carlson et al. | 52/404 X |
| 4,471,592 | 9/1984 | MacKinnon, Jr. et al. | 52/404 |
| 4,512,130 | 4/1985 | Pepin | 52/404 |

OTHER PUBLICATIONS

Architectural Record, "Condensation Control for Houses Feb./1956.

*Primary Examiner*—William F. Pate, III
*Assistant Examiner*—Creighton Smith
*Attorney, Agent, or Firm*—Ivor M. Hughes

[57] ABSTRACT

An insulation system suitable for rapidly securing insulation to the interior surface of a basement wall, comprising a continuous roll of flexible insulation of a length substantially greater than its width and having an impermeable vapor barrier continuously laminated on one side thereof and in intimate contact therewith, the continuous roll being cut in sections of a length determined by the dimensions of a corresponding section of the interior surface of a basement wall to be covered, each section of insulation being supported tautly against the wall by at least one continuous fastening strip.

13 Claims, 15 Drawing Figures

SYSTEM FOR INSULATING THE INTERIOR SURFACE OF BASEMENT WALLS, STRUCTURES AND COMPONENTS THEREFOR

FIELD OF INVENTION

This invention relates to an improved system for insulating the interior surface of basement walls, structures and components therefor and method of assembling same.

BACKGROUND OF INVENTION

Uninsulated basements are recognized as a significant source of heat loss in homes. Basement walls typically extend above the grade of soil which is backfilled along the exterior of the basement walls. Below grade, soil has some degree of insulative value, however depending upon the severity of climate, soil may freeze many feet below grade. Heat from the interior of the basement may be conducted through the walls and lost to the relatively cooler soil. Where the water content of the soil is high as in the eastern portions of North America, the insulative value of the soil declines and basement heat loss through conduction may become substantial. In addition, where exterior moisture in the soil penetrates the basement walls a number of effects may ensue. Moisture may freeze in the wall and expand, thereby damaging the walls. When such moisture penetrates to the warm interior surface of the wall it evaporates, and the energy required for this evaporation comes from the heat content of the basement air and results in a temperature drop. Thus it is important to protect the basement from loss of heat through both conduction and evaporation. Water vapour inside a basement may also penetrate a basement wall, moving from the interior to the exterior of the wall until it freezes, at which time it expands causing damage similar to that when exterior moisture in the soil penetrates the basement walls.

Above grade, the joists of a home sit on the top of the basement walls, creating an air space which must be insulated against loss of heat through conduction and infiltration of air from the outside. It is therefore necessary to insulate a basement wall over the surface area extending from the joist spacing to at least the limit at which the surrounding soil may freeze. To this end building codes for new homes have set limits for the thermal resistance (R value) of basement walls and the permeability of barriers to be applied to prevent the movement of interior water vapour into walls.

One method of construction which is used most widely in the erection of new homes in Canada, calls for basements constructed of cast in place concrete. Below grade, the exterior of the concrete wall is coated to make it substantially impermeable to moisture. The interior surface of the wall is insulated against the conduction of heat and a vapour barrier is used to cover the surface of the insulation which is facing the warm air of the basement. Typically in new homes batts of fibreglass insulation are the chosen insulative material. Present construction methods typically consist of affixing a breather type sheating paper (such as tar paper) to the basement inner wall extending from the sill plate on top of the basement wall down to the chosen limit of insulation. Wood strapping is then affixed over the sheating paper to provide a grid of compartments of sufficient depth to accommodate standard sizes of fibreglass batts which are supported in the compartments by a frictional fit. The strapping and batts are then covered with a vapour barrier, such as 6 mm thick polyethylene. Fibreglass batts are then stuffed into the joist spacing and a separate application of a vapour barrier is placed over the insulation.

A number of disadvantages are associated with the installation of fibreglass batts according to present construction methods:

(a) Cast in place concrete basement walls have surface undulations. When wood strapping is installed abutting the wall there are intermittent gaps of approximately three inches (3") between the strapping and the wall. Shims are used to support the strapping proximate these gaps. It is therefore difficult to maintain a close fit between the wall and the strapping, and between the batts and the wall. Spaces are created between the wall and the vapour barrier where moist air can circulate. The application of sheating paper next to the basement inner wall cannot entirely protect the wood from circulating moisture. The wood strapping is therefore subject to mildew and fungus. It has been known to eliminate the use of wood as a material for supporting insulation in applications above a basement. For example, in the case of metal buildings where a combination of insulation and reinforced nylon vapour barrier is glued to the interior surface of a roof or where such insulation is glued to the interior surface of walls.

(b) Typically construction code requirements stipulate use of insulation adjacent to the basement wall of a thermal resistance rated at R8 and in the joist spacing at R12. The average thermal resistance of wood strapping is R1.5—therefore when the batts of insulation are placed in a wood strapping framework by frictional fit, the strapping provides a thermally conducting bridge of lower resistance than the batts thereby lowering the thermal resistance of the insulative barrier composed of R8 fibreglass batts and R1.5 strapping to approximately R4 in place.

(c) The joist spacing is insulated by an application of batts separately from the wall. In practice the 6 mm polyethylene vapour barrier is not continuous because it is applied over the joist spacing and wall separately. Air may circulate across the barrier at the seam of adjoining sections of 6 mm polyethylene or where the vapour barrier is punctured when it is stapled in place.

(d) The installation of fibreglass batts is labour intensive and therefore an added cost in as much as six identifiable labour steps are involved: (i) apply sheeting paper moisture barrier to wall, (ii) install wood strapping frame comprising carpentry, (iii) cut to size and install fibreglass batts between strapping, (iv) apply vapour barrier over installed insulation on wall, (v) cut to size and install fibreglass batts in joist spacing, and (vi) apply vapour barrier over installed insulation in joist spacing.

(e) Usually builders only meet minimum building code requirements and insulate only the partial height of the wall extending from the top of the wall. Where a homeowner wishes to finish a basement wall to the full wall height, that is, extend the insulation to the floor, the existing application of insulation cannot be removed to accommodate a full wall height structure without damaging it since it is not mechanically fastened to the basement wall.

It is therefore an object of this invention to provide an improved system for insulating the interior surface of basement walls.

It is a further object of this invention to provide an improved method of installing insulation in basements.

Further and other objects of this invention will be realized by those skilled in the art from the following summary of the invention and detailed description of preferred embodiments thereof.

SUMMARY OF INVENTION

According to one aspect of the invention for insulating the interior walls of a basement there is provided an insulation system suitable for rapidly securing insulation to the interior surface of a basement wall, comprising a continuous roll of flexible insulation of a length substantially greater than its width and having an impermeable vapour barrier continuously laminated on one side thereof and in intimate contact therewith, the continuous roll being cut in sections of a length determined by the dimensions of a corresponding section of the interior surface of a basement wall to be covered, each section of insulation being supported tautly against the wall by means of at least two continuous fastening strips.

According to a preferred embodiment of the invention the roll of flexible insulation cut to one or more sections of a predetermined length may be supported taut against the interior surface of a basement wall by means of at least one continuous roll of a mechanical fastener which may be cut in sections or strips of a length determined by the length of the one or more sections of insulation arranged in a rectilinear fashion to be supported, the fastening strip being anchored to the interior surface of a basement wall and carrying a row of projections extending laterally away from the strip at periodic intervals so as to impale the one or more sections of insulation arranged in a rectilinear fashion at periodic intervals by piercing first the insulative layer and secondly the vapour barrier layer of the insulation and then bending the laterally extending projections so as to lie flush against the surface of the vapour barrier facing away from the interior surface of the basement wall. Preferably an adhesive patch constructed of an impermeable material may be provided to adhere to the vapour barrier over the puncture site and seal the same.

According to a preferred embodiment of the invention the continuous roll of flexible insulation may be constructed of (i) a first layer of insulation of a predetermined width corresponding practically to a portion of the height or length of the interior surface of a basement wall to be covered in a continuous application of the continuous roll of flexible insulation to a wall, and of a predetermined length substantially greater than the width sufficient to permit practically the roll to be affixed to a wall in a continuous application; by means of a mechanical fastening strip; and, (ii) a second layer of an impermeable vapour barrier continuously laminated in intimate contact with one side of the insulation layer which overextends the upper and lower edges running the length of the layer of insulation so as to provide a continuous upper tab and lower tab of vapour barrier, each tab running the length of the roll either being suitable to form a seal between the longitudinal edges of the roll and an abutting section or sections of insulation or each longitudinal tab being suitable to form a seal between the longitudinal edges of the roll and the interior surface of the basement wall by affixing the upper tab or lower tab in intimate contact with the interior surface of the basement wall.

According to a preferred embodiment of the invention at least one of the vapour barrier tabs running along the length of one edge of the roll may be folded over to comprise a tube (hereinafter referred to as the "tube") for receiving a fastening strip. According to this embodiment of the invention the fastening strip may comprise a continuous flat strip of metal or plastic composition, of a width suitable to be fed into the tube and of a length determined by the length of the tube which corresponds to the length of the particular section of the roll of insulation, and may be mechanically fastened to the interior surface of the basement wall.

According to a preferred embodiment of the invention there is provided an insulation system suitable for rapidly securing insulation to the interior surface of a basement wall whereby the roll of insulation of a length substantially greater than its width may be arranged in a lengthwise fashion in relation to the top of the basement wall so as to extend in a horizontal orientation. According to this embodiment of the invention the roll of insulation is cut into a section or sections of a length determined by the length of a corresponding horizontal section of basement wall to be covered. Preferably the section of insulation may be supported tautly against the interior surface of the basement wall by, (i) a continuous fastening strip affixed to the interior surface of the basement wall extending horizontally proximate the top of the wall carrying a row of projections extending laterally away from the strip at periodic intervals for impaling and supporting the upper portion of the section of insulation; and, (ii) a second fastening strip affixed to the interior surface of the basement wall extending horizontally and spaced below the top of the basement wall proximate the lower edge of the supported section of insulation, the second fastening strip comprising either a row of projections spaced at periodic intervals for impaling the lower edge of the section of insulation or a continuous flat strip to be fed into a tube extending along the bottom length of the section of insulation and mechanically fastened to the interior surface of the basement wall.

Preferably, where the roll of insulation is to be supported lengthwise in a horizontal orientation, the roll of insulation may be of a predetermined width sufficient to extend from the top of the basement wall downwardly to a limit corresponding substantially to one half of the height of the wall. Preferably where an added degree of insulation is necessary, a second roll of insulation may be supported lengthwise in a horizontal orientation below the first roll of insulation and may extend substantially from the mid-height of the basement wall downwardly to the base of the wall. Where two rolls of insulation are installed lengthwise in a horizontal orientation abutting one above the other, the abutting vapour barrier tabs may be arranged to overlie the vapour barrier of the lower or upper roll of insulation so as to provide a vapour barrier seal extending continuously over the top and bottom rolls of insulation. Preferably the bottom roll of insulation may be supported tautly against the interior surface of the basement wall by (i) a fastening strip affixed to the interior surface of the basement wall extending horizontally proximate the mid-height of the basement walls having a row of projections spaced at periodic intervals for impaling and supporting the upper portion of the bottom section of insulation; and, (ii) the lower vapour barrier tab depending from the bottom roll of insulation may be mechanically fastened to abut in intimate contact with the interior surface of the basement wall proximate its base.

According to a preferred embodiment of the invention where a roll of flexible insulation is to be supported proximate the top of the wall, the roll of insulation may be of a predetermined width sufficient to permit the top longitudinal edge of the roll to extend above the sill plate whereby such overextending portion of the roll may be folded directly into the joist spacing and simultaneously cut so as to fit around the joists extending transversely into the joist spacing. According to another preferred embodiment of the invention separate batts of insulation may be fitted into the spacing between the joists, and the roll of flexible insulation to be supported proximate the top of the wall may be of a predetermined width so as to permit the impermeable vapour barrier tab overextending the longitudinal edge of the roll to be folded directly into the joist spacing and simultaneously cut so as to fit around the joists extending transversely into the joist spacing and cover the separate batts of insulation filled therein.

According to another aspect of the invention there is provided a method of rapidly insulating the interior surface of a basement wall comprising the steps of:

(a) affixing a top continuous fastening strip to the interior surface of a basement wall so as to extend horizontally proximate the top of the wall, the strip carrying a row of projections extending laterally away from the strip at periodic intervals;

(b) affixing at least a second such continuous fastening strip carrying laterally extending projections to the interior surface of a basement wall spaced below the first continuous fastening strip a distance corresponding substantially to the width of the continuous roll of flexible insulation to be applied;

(c) unrolling the continuous roll of flexible insulation on the basement floor next to at least one rectilinear section of wall with the vapour barrier facing downward and cutting the continuous roll in sections of a length corresponding to the length of the adjacent rectilinear section of the interior surface of the basement wall;

(d) lifting that portion of the section of flexible insulation closest the wall upward, first impaling the longitudinally extending vapour barrier tab upon the laterally extending projections of the second continuous fastening strip, then folding the entire section of flexible insulation upward so as to fold the longitudinally extending vapour barrier tab behind the lower most extending edge of the section of insulation and impaling such longitudinally extending bottom edge through both the insulative layer and the impermeable vapour layer;

(e) lifting the upper most longitudinally extending edge of the section of insulation upward, drawing the section of flexible insulation taut and impaling such upper portion upon projections extending laterally away from the top continuous fastening strip at periodic intervals;

(f) bending the projections on the at least two fastening strips so as to lie flush against the vapour barrier.

Preferably, in the method of insulating a basement, an adhesive patch constructed of an impermeable material may be glued over the plurality of projections lying flush against the vapour barrier to seal such puncture sites in the vapour barrier.

According to another preferred embodiment of the invention, where the roll of flexible insulation in a preferred embodiment has at least one of the vapour barrier tabs comprising a tube for receiving a fastening strip, there is provided a method of rapidly insulating the interior surface of a basement wall which may comprise the steps of:

(a) affixing a top continuous fastening strip to the interior surface of a basement wall so as to extend horizontally proximate the top of the wall, the strip carrying a row of projections extending laterally away from the strip at periodic intervals;

(b) unrolling the continuous roll of flexible insulation on the basement floor next to at least one rectilinear section of wall with the vapour barrier facing downward, the tube for receiving a fastening strip adjacent the wall, and cutting the continuous roll in sections of a length corresponding to the length of the adjacent rectilinear section of the interior surface of the basement wall;

(c) lifting that portion of the section of flexible insulation most remote the wall upward and impaling the uppermost longitudinally extending edge of the section of insulation upon the laterally extending projections of the top continuous fastening strip;

(d) inserting the continuous flat strip comprising a fastening strip into the tube for receiving same;

(e) and, drawing the section of flexible insulation downward until it is taut, thereafter anchoring the fastening strip against the interior surface of the basement wall.

Preferably, where the section of insulation is of a predetermined height sufficient to permit the top longitudinally extending edge of the section to extend above the sill plate, there may be provided a method of rapidly insulating the interior surface of a basement wall comprising the further steps of;

(f) folding the top longitudinally extending edge of the section into the joist spacing and simultaneously making cuts perpendicular to such longitudinally extending edge so as to fit the longitudinal extending edge of the section around the joists extending transversely into the joist spacing. According to another preferred embodiment of the invention where the section of insulation is of a predetermined height sufficient to permit the top longitudinally extending edge of the section to extend upward only to the limit of the sill plate, there may be provided a method of rapidly insulating the interior surface of a basement wall comprising the further step of;

(g) cutting pieces of insulation to fit into the joist spacing between each joist extending transversely into the space, installing such pieces of insulation by frictional fit, and folding the vapour barrier tab extending longitudinally along the top longitudinally extending edge of the section of flexible insulation into the joist spacing to cover the pieces of insulation installed in the joist spacing, simultaneously cutting such longitudinally extending vapour barrier tab to fit around the joists.

The invention will now be illustrated with reference to the following drawings of an embodiment of the invention.

DESCRIPTION OF PREFERRED EMBODIMENT OF THE INVENTION

Figure 1:
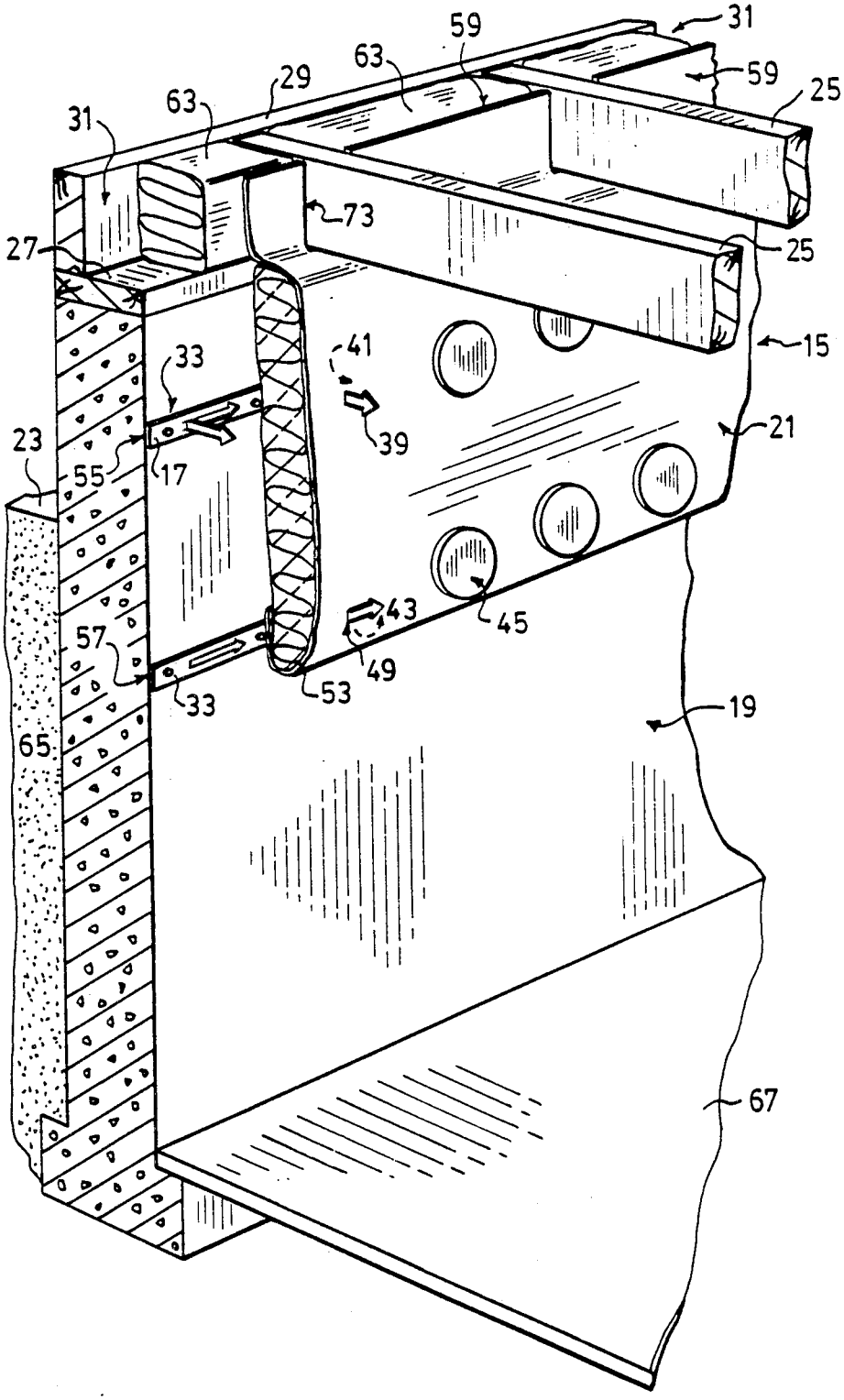
FIG. 1 is a perspective view of one embodiment of an insulation system mechanically fastened to the interior of a basement wall.
Figure 2:
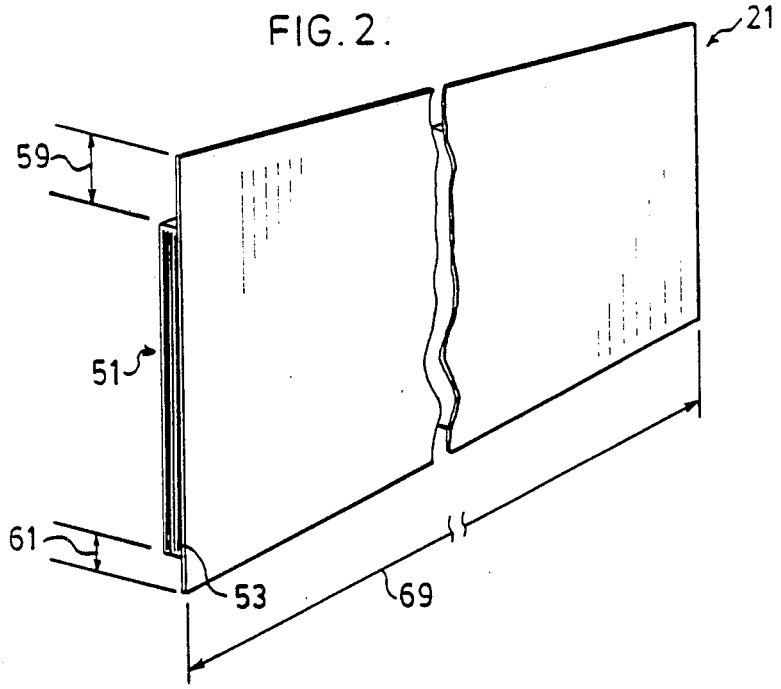
FIG. 2 (seen with FIGS. 4 and 5) is a perspective view of a continuous section of laminated flexible insulation.
Figure 4:
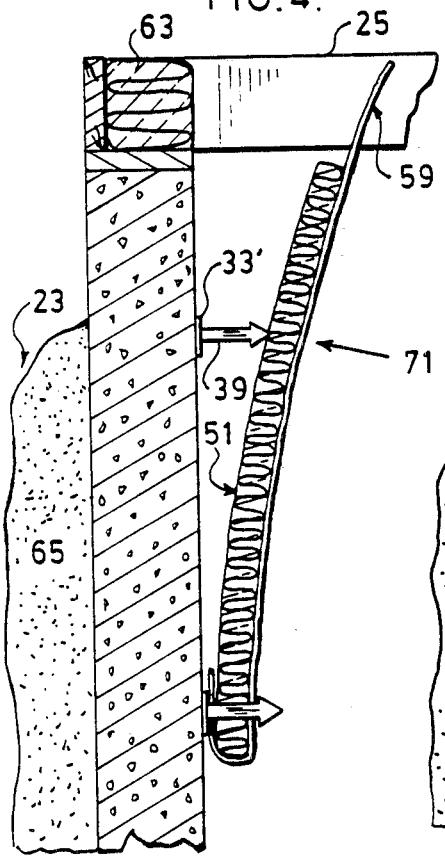
FIG. 4 (seen with FIGS. 2 and 5) is a side view of a basement wall and section of insulation also shown in FIGS. 3 and 5 comprising a step in a method of insulating a basement.
Figure 5:
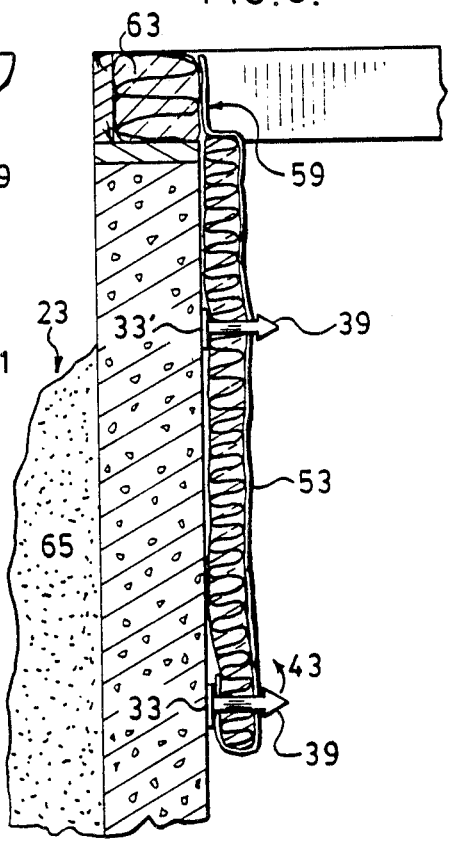
FIG. 5 is a side view of a basement wall and section of insulation also shown in FIGS. 3 and 4, comprising a step in a method of insulating a basement.

With reference to FIGS. 1 and 2 and insulation system 15 is shown comprising a plurality of mechanical fasteners 17 anchored to a basement wall 19 and supporting a substantially continuous roll or sheet of flexible insulation 21. Referring to FIG. 2, insulation 21 comprises at least one layer of flexible insulation 51 to which one layer of a substantially impermeable vapour barrier 53 is continuously laminated in intimate contact. Insulation system 15 is designed to insulate a basement of typical construction, comprising a cast in place concrete wall 19 which extends above and below grade 23. Joists 25 rest on sill plate 27 behind a wooden facing beam or plate 29, thereby creating a joist spacing 31.

Figure 6:
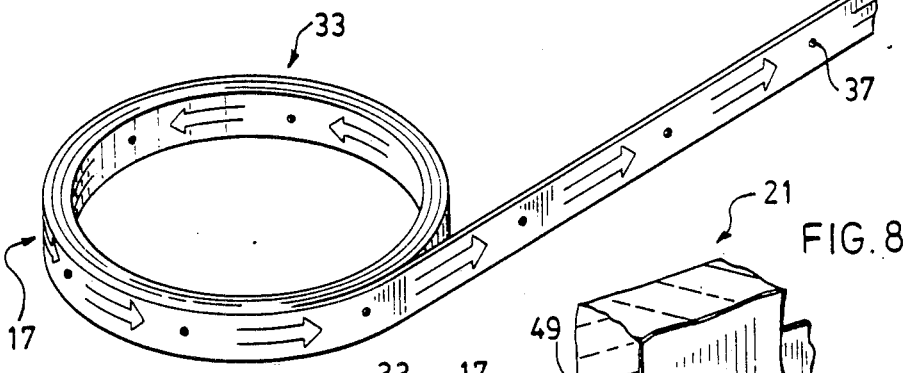
FIG. 6 is a perspective view of a mechanical fastening deivce.
Figure 7:
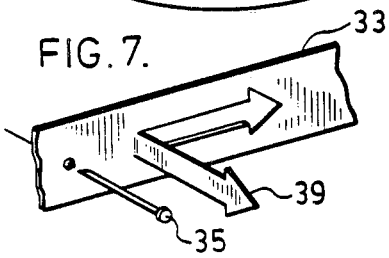
FIG. 7 is a perspective view of a segment of the mechanical fastening device shown in FIG. 6.
Figure 8:
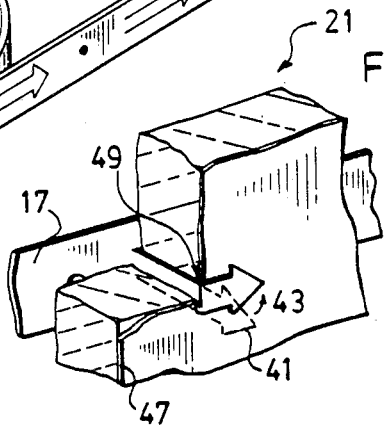
FIG. 8 is a perspective view of the mechanical fastening device shown in FIGS. 6 and 7.
Figure 9:
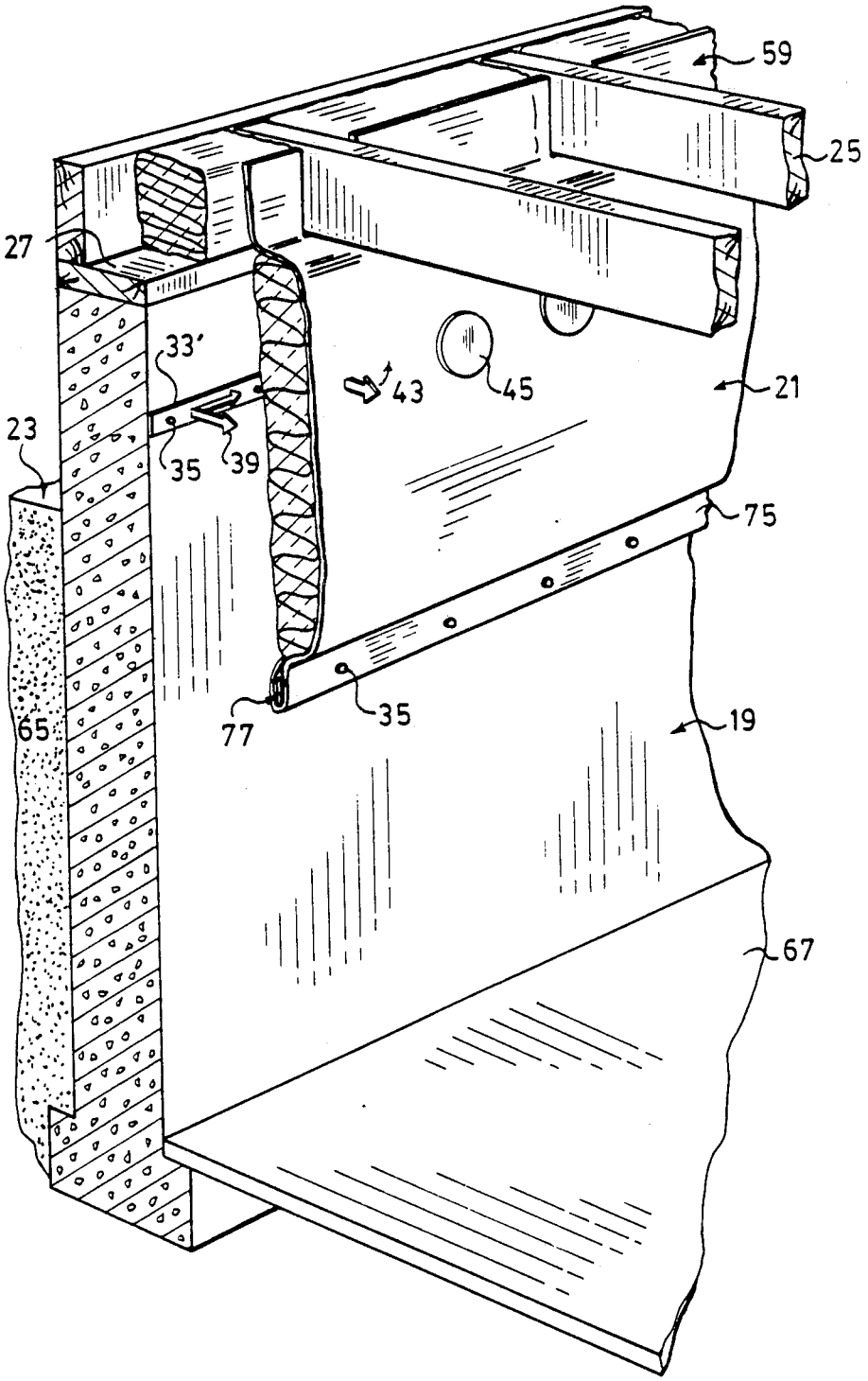
FIG. 9 is a perspective view of another embodiment of an insulation system mechanically fastened to the interior of a basement wall.

With reference to FIGS. 6, 7, and 8 mechanical fasteners are provided, which need only be capable of being anchored to a basement wall so as to provide a rectilinear plurality of sites for impaling a section of insulation 21 at periodic intervals. A continuous metal strip 33 of the type manufactured by Insulhold TM is the preferred mechanical fastener 17. Strip 33 is unrolled and anchored to basement wall 19 using concrete nails 35 at holes 37 in strip 33. Strip 33 carries arrow shaped projections 39 which extend laterally from the surface of the wall 19 once the strip is anchored. Referring to FIGS. 1 and 8, fastener 17 is anchored to basement wall 19, and supports insulation 21 on projection 39. Projection 39 impales insulation 41 and is then bent 43 to lie flush with insulation. An adhesive patch 45 may be used to seal the vapour barrier 53 at the puncture site 49.

Referring to FIGS. 1 and 2 in the insulation system 15 shown, at least two strips 33 are anchored to basement wall 19 in a horizontal spaced apart relationship so as to support upper 55 and lower 57 portions of the insulation 21. Insulation sheet 21 has a vapour barrier 53 which overextends the top edge and bottom edge of the flexible insulation 51 so as to provide a substantially continuous upper tab 59 and lower tab 61. Lower tab 61 is folded behind insulation 51 when the lower portion 57 of the insulation is mechanically fastened to the basement wall to provide a moisture seal. Referring to FIG. 1, the joist spacing 31 is insulated with batts of insulation 63 stuffed into the space. The upper tab 59 of the vapour barrier 53 covers the batts 63 in joist spacing 31 to provide a moisture seal.

Figure 3:
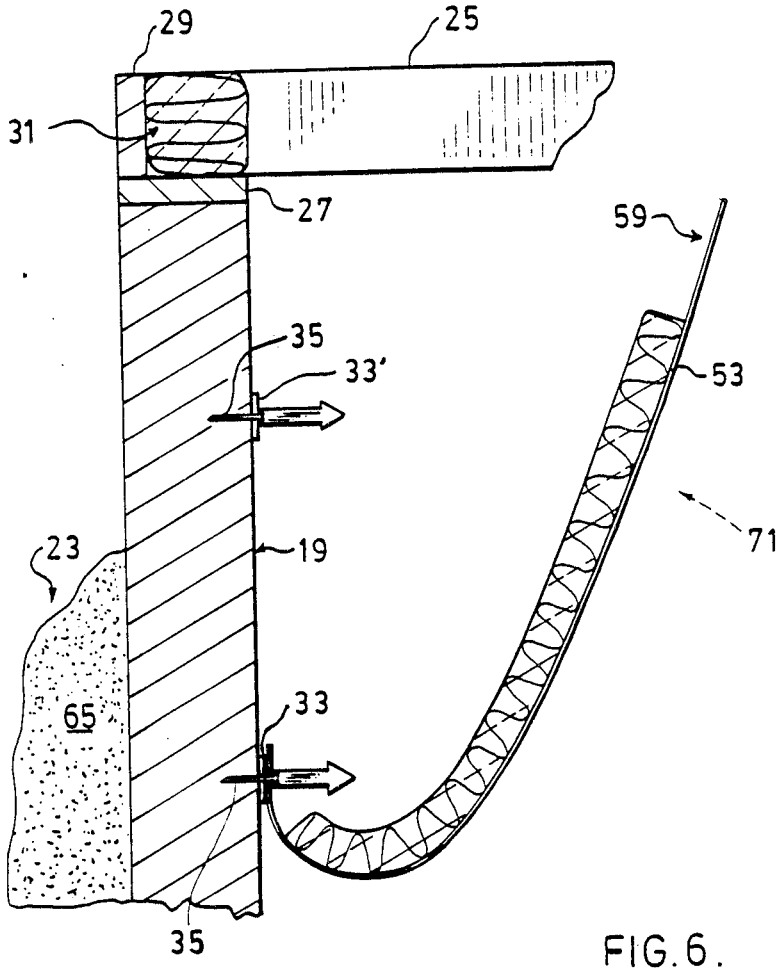
FIG. 3 (seen with FIGS. 6, 7, and 8) is a side view of a basement wall and a section of insulation, comprising a step in a method of insulating a basement.

With reference to FIGS. 2, 3, 4, and 5 a method of insulating the interior wall of a basement 19 is shown. An upper strip 33 is anchored approximately six inches (6") below the sill plate 27. A second strip 33 is anchored lower down on the wall at a depth corresponding to the width of the insulation 21. It will be appreciated that the depth to which the wall 19 is insulated is determined by the depth to which the exterior soil 65 may freeze below grade 23. Referring to FIG. 3 the roll or sheet of flexible insulation 21 is placed with the vapour barrier 53 facing the basement floor 67 next to the wall 19 and cut to the length 69 of the wall 19. The lower tab 61 of the vapour barrier 53 is impaled on the projections 39 of the lower strip 33 and the entire sheet of insulation 21 is lifted 71 until the lower portion 57 of the insulation 21 is impaled (best seen in FIG. 4). The rest of the sheet of insulation 21 is then lifted 71 up and the upper portion 55 of the insulation 21 is then impaled on the projections 39 of the upper strip 33'. The projections 39 are then bent 43 (best seen in FIGS. 1, 8, and 5) so as to lie flush with the vapour barrier 53, after which the adhesive patches 45 may be applied. The batts of insulation 63 may be installed in the joist spacing 31 either before or after the roll or sheet of insulation 21 is mechanically fastened to the wall 19. Once both the batts 63 and the insulation 21 are in place, the upper tab 59 of the vapour barrier 53 is folded up to cover the batts 63 in the joist spacing 31 and simultaneously cut along vertical sections 73 (best seen in FIG. 1) to fit around the joists 25.

With reference to FIGS. 9, 10, 11, and 12 another embodiment for insulating the interior wall 19 of a basement is shown. A sheet of insulation 21 is shown, similar to that depicted in FIG. 2. Insulation sheet 21 has a vapour barrier 53 which overextends the top edge and bottom edge of the flexible insulation 51 so as to provide a substantially continuous upper tab 59 and lower tube 75. Lower tube 75 is adapted to receive a continuous flat fastening strip 77. To install the sheet of insulation 21, a continuous fastening strip $33^1$ is anchored approximately six inches (6") below the sill plate 27.

Figure 10:
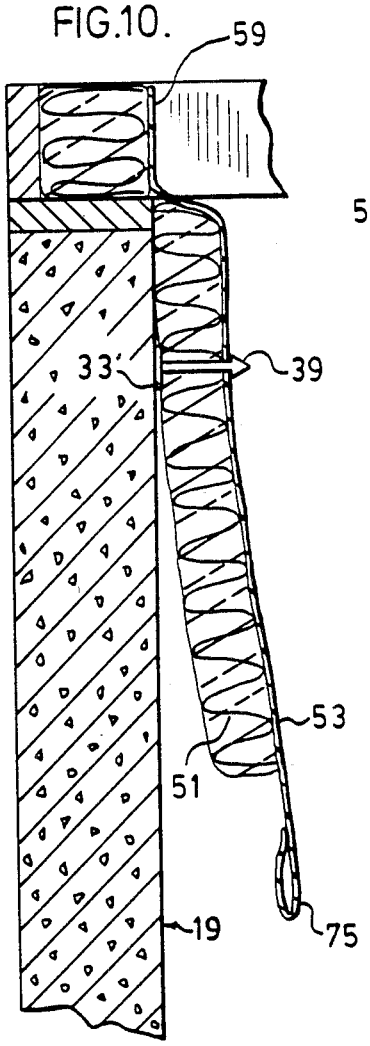
FIG. 10 (seen with FIGS. 11 and 12) is a side view of a basement wall and a section of insulation, comprising a step in a method of insulating a basement.
Figure 11:
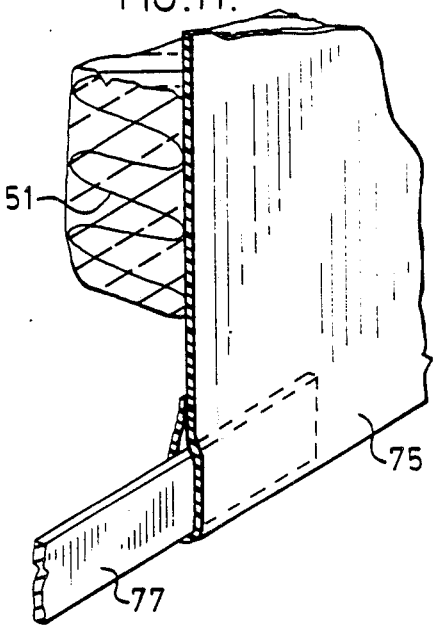
FIG. 11 is a close up perspective view of another embodiment of a fastening strip.
Figure 12:
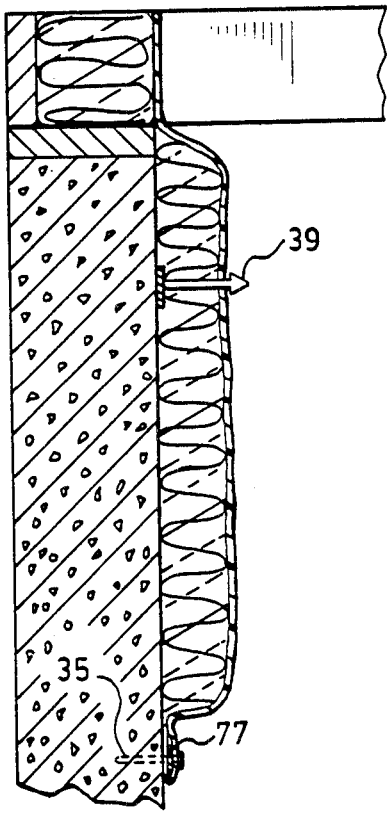
FIG. 12 is a side view of a basement wall and a section of insulation, comprising a step in a method of insulating a basement.

With reference to FIG. 10 the sheet of insulation 21 is impaled upon the top fastening strip $33^1$. The fastening strip 77 is inserted into the lower tube 75 (best seen in FIG. 11). The sheet of insulation 21 may then be drawn downwards until it is taut and the fastening strip 77 anchored to the wall 19 by means of a concrete nail 35, for example a pneumatically injected nail. Projections 39 carried by the top fastening strip $33^1$ are then bent 43 (best seen in FIG. 9) so as to lie flush with the vapour barrier 53, after which adhesive patches 45 may be applied.

Figure 13:
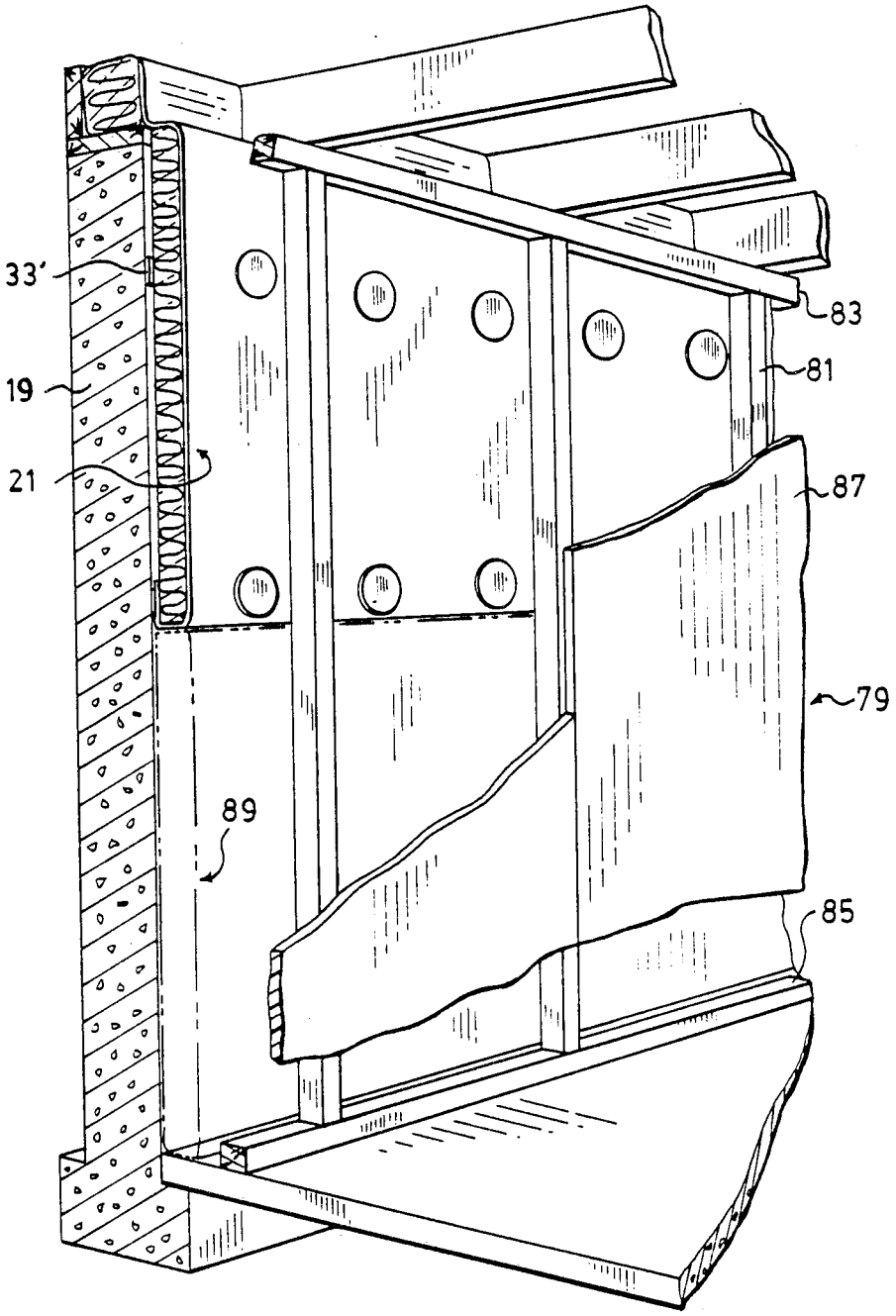
FIG. 13 is a perspective, partially cut away view of an insulation system.
Figure 14:
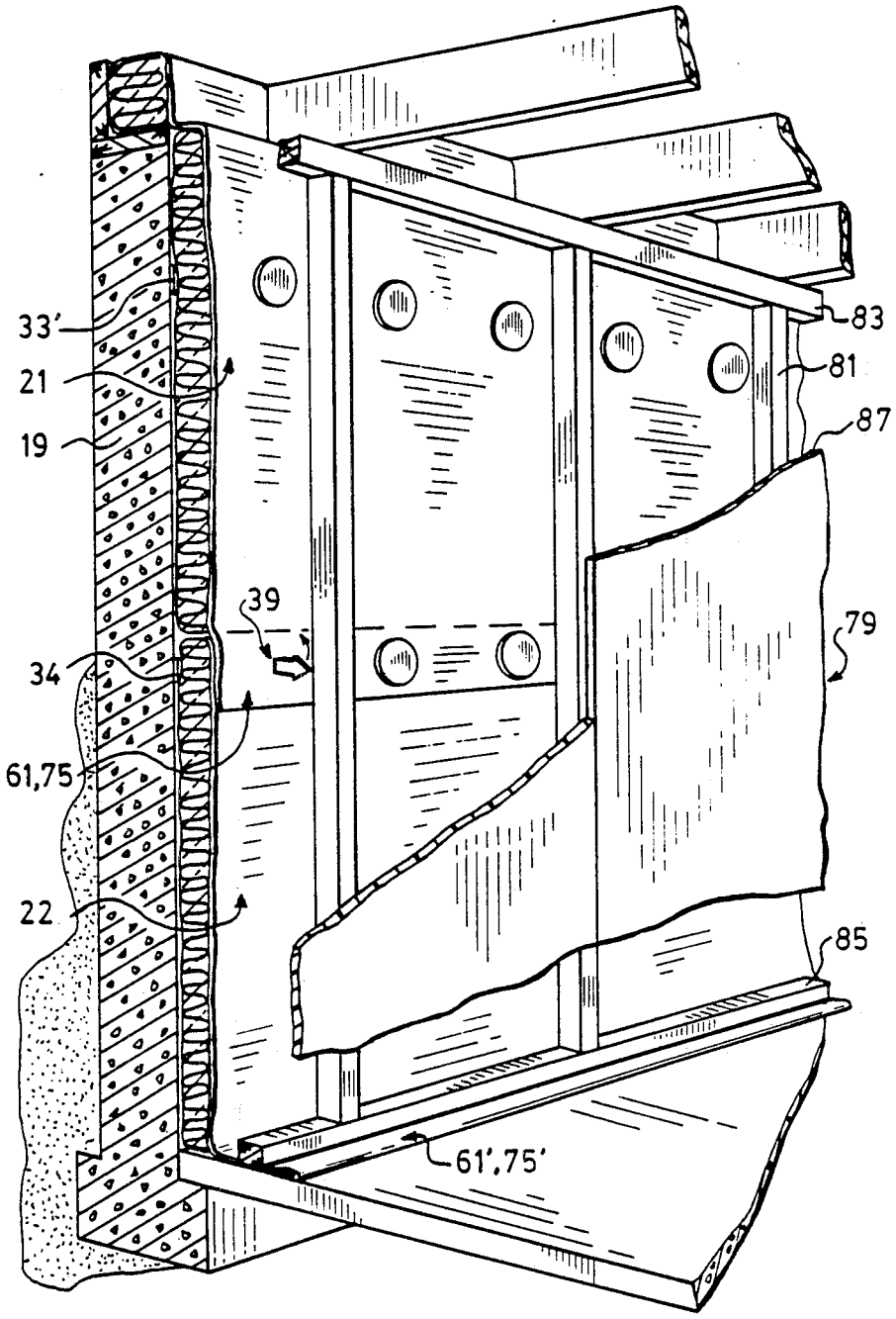
FIG. 14 is a perspective, partially cut away view of an insulation system, in another embodiment.

With reference to FIGS. 13 and 14, the insulation system may be covered with a frame wall 79 consisting of vertical posts 81 attached between a ceiling beam 83 and a base board 85. A facing material 87 may be applied over the frame wall 79. The frame wall 79 is spaced from the basement wall 19 so that there is no thermal bridge composed of material such as wood strapping, that will conduct cold between the basement wall 19 and the frame wall 79, 87. With particular reference to FIG. 13, where the sheet of insulation 21 is installed to a partial wall height (best seen in FIGS. 1 and 9) an air space depicted by dotted lines 89 may be left behind the frame wall 79. With particular reference to FIG. 14, sheets of insulation 21, 22 may be installed to the full height of the wall. In one embodiment the top sheet of insulation is impaled upon the top fastening strip $33^1$, as depicted in the previous reference to FIG. 10. The lower sheet of insulation 22 is then impaled upon a second fastening strip 34 suitably positioned at approximately the mid-height of the wall 19. The continuous tab 61, 75 may be arranged to overlie the vapour barrier of the lower sheet of insulation 22. The bottom continuous tab of the lower sheet of insulation (identified as $61^1$, $75^1$ in FIG. 14) may be arranged to lie under the base board 85. A vapour barrier seal extending continuously from the joist spacing 31 to the basement floor is thereby achieved.

Figure 15:
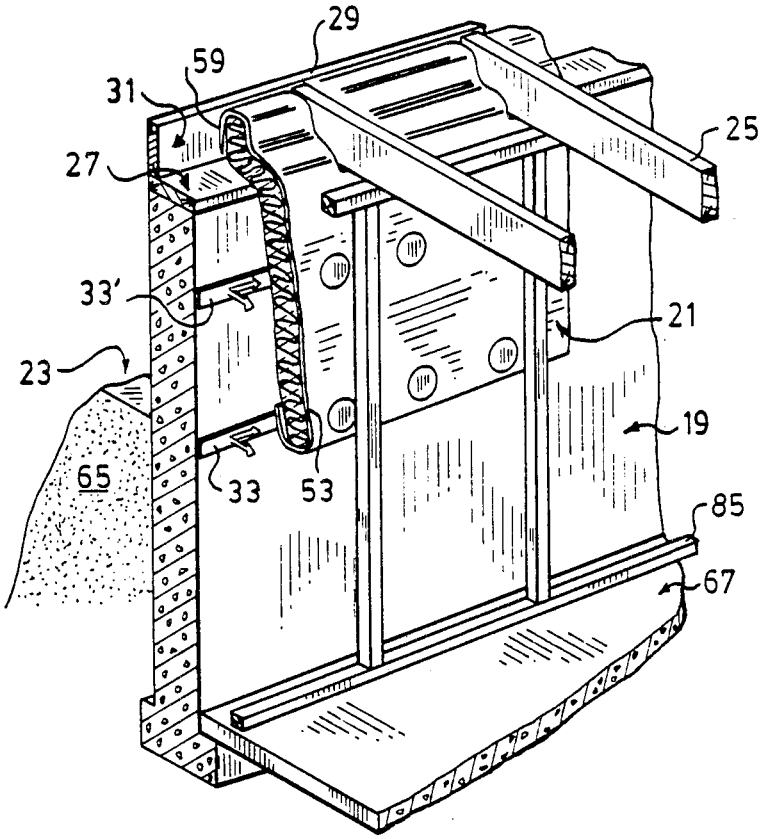
FIG. 15 is a perspective view of an embodiment of an insulation system.

With reference to FIG. 15, in one embodiment it is not necessary to apply separate batts of insulation 63 into the joist spacing 31 (as previously depicted in FIG. 1). The roll or sheet of flexible insulation 21 is of sufficient width to permit it to extend downwardly to the depth to which the exterior soil 65 may freeze below grade 23, and to extend upwardly to permit the flexible insulation 51 to be folded into the joist spacing 31, the upper tab 59 of the vapour barrier 53 to be folded behind the insulation 51 abutting the facing beam or plate 29 in a frictional fit.

As many changes can be made to the embodiment without departing from the scope of the invention, it is intended that all material contained herein be interpreted as illustrative of the invention and not in a limiting sense.

The embodiments of the invention in which an exclusive property or privilege is claimed are as follows:

1. An insulation system for rapidly securing insulation to the interior surface of a basement wall, comprising a continuous roll of flexible insulation having (i) a first layer of insulation of a predetermined width corresponding practically to a portion of the height or length of the interior surface of a basement wall to be covered in a continuous application of the continuous roll of flexible insulation to the basement wall, and of a predetermined length substantially greater than the width sufficient to permit practically the continuous roll to be affixed to a wall in a continuous application by means of at least one fastening strip; and, (ii) a second layer of an impermeable vapour barrier continuously laminated in intimate contact with one side of the first layer of insulation, the impermeable vapour barrier over-extending the upper and lower edges running the length of the first layer of insulation so as to provide at least one continuous tab of vapour barrier running the length of one edge of the roll of insulation suitable to form an overlapping seal with any abutting surface, and so as to provide at least a second continuous tab of vapour barrier running the length of the opposite edge of the roll of insulation, wherein the second continuous tab is folded over so as to comprise a tube for receiving the at least one fastening strip; the continuous roll of flexible insulation cut in sections of a length determined by the length of a corresponding section of the interior surface of a basement wall to be covered; the at least one fastening strip comprising a continuous flat strip of metal or plastic composition of a width suitable to be fed into the tube and of a length determined by the length of the tube which corresponds to the length of the particular section of the roll of flexible insulation, the said fastening strip when inserted in the tube suitable to be mechanically fastened to the interior surface of a basement wall; whereby, the section of insulation to be affixed to the interior surface of a basement wall is supported tautly against the basement wall at least by means of the fastening strip when inserted in the tube and mechanically fastened to the interior surface of a basement wall.

2. An insulation system suitable for rapidly securing insulation to the interior surface of a basement wall comprising a continuous roll of flexible insulation cut to one or more sections of a predetermined length, each section supported tautly against the interior surface of a basement wall only by means of at least two continuous rolls of a mechanical fastener cut to one or more sections or strips of a length determined by the length of the one or more sections of insulation arranged in a rectilinear fashion to be supported, the at least two fastening strips being anchored to the interior surface of a basement wall and carrying a row of projections extending laterally away from the strips at periodic intervals so as to impale the one or more sections of insulation arranged in a rectilinear fashion at periodic intervals by piercing first the insulative layer and secondly the vapour barrier layer of the insulation and then bending the laterally extending projections so as to lie flush against the surface of the vapour barrier facing away from the interior surface of the basement wall.

3. The insulation system of claim 1 wherein the continuous roll of flexible insulation is constructed of (i) a first layer of insulation of a predetermined width corresponding practically to a portion of the height or length of the interior surface of a basement wall to be covered in a continuous application of the continuous roll of flexible insulation to a wall, and of a predetermined length substantially greater than the width sufficient to permit practically the roll to be affixed to a wall in a continuous application; by means of a mechanical fastening strip; and, (ii) a second layer of an impermeable vapour barrier continuously laminated in intimate contact with one side of the insulation layer which overextends the upper and lower edges running the length of the layer of insulation so as to provide a continuous upper tab and lower tab of vapour barrier, each tab running the length of the roll either being suitable to form a seal between the longitudinal edges of the roll and an abutting section or sections of insulation or each longitudinal tab being suitable to form a seal between the longitudinal edges of the roll and the interior surface of the basement wall by affixing the upper tab or lower tab in intimate contact with the interior surface of the basement wall.

4. The insulation system of claim 2 wherein the continuous roll of flexible insulation is constructed of (i) a first layer of insulation of a predetermined width corresponding practically to a portion of the height or length of the interior surface of a basement wall to be covered in a continuous application of the continuous roll of flexible insulation to a wall, and of a predetermined length substantially greater than the width sufficient to permit practically the roll to be affixed to a wall in a continuous application; by means of a mechanical fastening strip; and, (ii) a second layer of an impermeable vapour barrier continuously laminated in intimate contact with one side of the insulation layer which overextends the upper and lower edges running the length of the layer of insulation so as to provide a continuous upper tab and lower tab of vapour barrier, each tab running the length of the roll either being suitable to form a seal between the longitudinal edges of the roll and an abutting section or sections of insulation or each longitudinal tab being suitable to form a seal between the longitudinal edges of the roll and the interior surface of the basement wall by affixing the upper tab or lower tab in intimate contact with the interior surface of the basement wall.

5. The insulation system of claim 3 wherein at least one of the vapour barrier tabs running along the length of one edge of the roll is folded over to comprise a tube for receiving a fastening strip, the fastening strip comprising a continuous flat strip of metal or plastic composition, of a width suitable to be fed into the tube and of a length determined by the length of the tube which corresponds to the length of the particular section of the roll of insulation, the said fastening strip suitable to be mechanically fastened to the interior surface of the basement wall.

6. The insulation system of claim 2 wherein the insulation system suitable for rapidly securing insulation to the interior surface of a basement wall comprises a roll of insulation of a length substantially greater than its width whereby the roll of insulation is arranged in a lengthwise fashion in relation to the top of a basement wall so as to extend in a horizontal orientation, the roll of insulation being cut into a section or sections of a length determined by the length of a corresponding horizontal section of basement wall to be covered, and supported against the interior surface of the basement wall tautly, by, (i) a continuous fastening strip affixed to the interior surface of the basement wall extending horizontally proximate the top of the wall carrying a row of projections extending laterally away from the strip at periodic intervals for impaling and supporting the upper portion of the section of insulation; and (ii) a second fastening strip affixed to the interior surface of the basement wall extending horizontally and spaced below the top of the basement wall proximate the lower edge of the supported section of insulation, the second fastening strip comprising either a row of projections spaced at periodic intervals for impaling the lower edge of the section of insulation or a continuous flat strip received by a tube extending along the bottom length of the section of insulation, the said flat strip mechanically fastened to the interior surface of the basement wall.

7. The insulation system of claim 6 wherein a roll of insulation supported lengthwise in a horizontal orientation, is of a predetermined width sufficient to extend from the top of the basement wall downwardly to a limit corresponding substantially to one half of the height of the wall.

8. The insulation system of claim 6 wherein a roll of insulation supported lengthwise in a horizontal orientation extends substantially from the mid-height of the basement wall downwardly to the base of the wall.

9. The insulation system of claim 6 wherein the roll of flexible insulation to be supported in a horizontal orientation proximate the top of the wall, is of a predetermined width sufficient to permit the top longitudinal edge of the roll to extend above the sill plate whereby such overextending portion of the roll is folded directly into the joist spacing and simultaneously cut so as to fit around the joists extending transversely into the joist spacing.

10. A method of rapidly insulating the interior surface of a basement wall comprising the steps of:

(a) affixing a top continuous fastening strip to the interior surface of a basement wall so as to extend horizontally proximate the top of the wall, the strip carrying a row of projections extending laterally away from the strip at periodic intervals;

(b) affixing at least a second such continuous fastening strip carrying laterally extending projections to the interior surface of a basement wall spaced below the first continuous fastening strip a distance corresponding substantially to the width of the continuous roll of flexible insulation to be applied;

(c) unrolling the continuous roll of flexible insulation on the basement floor next to at least one rectilinear section of wall with the vapour barrier facing downward and cutting the continuous roll in sections of a length corresponding to the length of the adjacent rectilinear section of the interior surface of the basement wall;

(d) lifting that portion of the section of flexible insulation closest the wall upward, first impaling the longitudinally extending vapour barrier tab upon the laterally extending projections of the second continuous fastening strip, then folding the entire section of flexible insulation upward so as to fold the longitudinally extending vapour barrier tab behind the lower most extending edge of the section of insulation and impaling such longitudinally extending bottom edge through both the insulative layer and the impermeable vapour layer;

(e) lifting the upper most longitudinaly extending edge of the section of insulation upward, drawing the section of flexible insulation taut and impaling such upper portion upon projections extending laterally away from the top continuous fastening strip at perodic intervals;

(f) bending the projections on the at least two fastening strips so as to lie flush against the vapour barrier.

11. The method of rapidly insulating the interior surface of a basement wall of claim 10 wherein the roll of flexible insulation has at least one vapour barrier tab comprising a tube for receiving a fastening strip, comprising the steps of:

(a) affixing a top continuous fastening strip to the interior surface of a basement wall so as to extend horizontally proximate the top of the wall, the strip carrying a row of projections extending laterally away from the strip at periodic intervals;

(b) unrolling the continuous roll of flexible insulation on the basement floor next to at least one rectilinear section of wall with the vapour barrier facing downward, the tube for receiving a fastening strip adjacent the wall, and cutting the continuous roll in sections of a length corresponding to the length of the adjacent rectilinear section of the interior surface of the basement wall;

(c) lifting that portion of the section of flexible insulation most remote the wall upward and impaling the uppermost longitudinally extending edge of the section of insulation upon the laterally extending projections of the top continuous fastening strip;

(d) inserting the continuous flat strip comprising a fastening strip into the tube for receiving same;

(e) and, drawing the section of flexible insulation downward until it is taut, thereafter anchoring the fastening strip against the interior surface of the basement wall.

12. The method of rapidly insulating the interior surface of a basement wall of claim 10 wherein the section of insulation is of a predetermined height sufficient to permit the top longitudinally extending edge of the section to extend above the sill plate, comprising the further steps of;

(a) folding the top longitudinally extending edge of the section into the joist spacing and simultaneously making cuts perpendicular to such longitudinally extending edge so as to fit the longitudinal extending edge of the section around the joists extending transversely into the joist spacing.

13. The method of rapidly insulating the interior surface of a basement wall of claim 10 wherein the section of insulation is of a predetermined height sufficient to permit the top longitudinally extending edge of the section to extend outward only to the limit of the sill plate, comprising the further step of;

(a) cutting pieces of insulation to fit into the joist spacing between each joist extending transversely into the space, installing such pieces of insulation by frictional fit, and folding the vapour barrier tab extending longitudinally along the top longitudinally extending edge of the section of flexible insulation into the joist spacing to cover the pieces of insulation installed in the joist spacing, simulataneously cutting such longitudinally extending vapour barrier tab to fit around the joists.

* * * * *

UNITED STATES PATENT AND TRADEMARK OFFICE

CERTIFICATE OF CORRECTION

PATENT NO. : 4,653,241

DATED : March 31, 1987

INVENTOR(S) : Rene Bindi

It is certified that error appears in the above-identified patent and that said Letters Patent is hereby corrected as shown below:

In column 7 at line 7, at the end of the paragraph after 'fastening', the word "deivce." has been deleted and the word ---device.--- substituted therefor.

Signed and Sealed this

Sixth Day of October, 1987

*Attest:*

*Attesting Officer*

DONALD J. QUIGG

*Commissioner of Patents and Trademarks*